US011845262B2

(12) United States Patent
Davis

(10) Patent No.: US 11,845,262 B2
(45) **Date of Patent: *Dec. 19, 2023**

(54) PLATEN ASSEMBLY FOR PRINTING ON FACE MASKS

(71) Applicant: Ricardo George Davis, Brooklyn, NY (US)

(72) Inventor: Ricardo George Davis, Brooklyn, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/674,411

(22) Filed: Feb. 17, 2022

(65) Prior Publication Data

US 2022/0169004 A1 Jun. 2, 2022

Related U.S. Application Data

(63) Continuation of application No. 16/985,722, filed on Aug. 5, 2020, now Pat. No. 11,254,116.

(51) Int. Cl.

| | |
|---|---|
| ***B41F 15/18*** | (2006.01) |
| ***B41F 17/00*** | (2006.01) |
| ***D06P 5/00*** | (2006.01) |
| *A41D 13/11* | (2006.01) |

(52) U.S. Cl.

CPC ..... *B41F 17/005* (2013.01); *B41F 15/18* (2013.01); *D06P 5/00* (2013.01); *A41D 13/11* (2013.01)

(58) Field of Classification Search

CPC ..... B41F 15/18

USPC ..... 101/115, 126, 474

See application file for complete search history.

(56) References Cited

U.S. PATENT DOCUMENTS

| | | | | |
|---|---|---|---|---|
| 5,107,758 | A * | 4/1992 | Withers | B41F 15/18 101/35 |
| 2003/0197772 | A1* | 10/2003 | Iwatsuki | B41J 3/4078 347/104 |
| 2004/0000240 | A1* | 1/2004 | Oleson | B41F 15/22 101/126 |
| 2006/0203069 | A1* | 9/2006 | Niimi | B41J 3/4078 347/104 |
| 2017/0320339 | A1* | 11/2017 | Matsumoto | B41J 11/06 |

* cited by examiner

*Primary Examiner* — Leslie J Evanisko

(74) *Attorney, Agent, or Firm* — The Keys Law Firm, PLLC

(57) ABSTRACT

A platen assembly for printing on face masks which includes a base member having a plurality of jig members mounted thereon. The base member has a top surface and a bottom surface, with its bottom surface operative to attach to a platen holding mechanism of a conventional direct to garment printer. Each of the jig members may be attached to the top surface of the base member and hold a single face mask in such a manner that it can be printed on. Edges of the base member and of each jig member include interface portions which allow portions of the face mask to be selectively threaded through to more effectively keep the face masks in place, being held smooth and taught.

14 Claims, 9 Drawing Sheets

PLATEN ASSEMBLY FOR PRINTING ON FACE MASKS

CROSS REFERENCE TO RELATED APPLICATIONS

This application is a continuation of, claims the benefit of, and incorporates by reference co-pending U.S. patent application Ser. No. 16/985,722 filed Aug. 5, 2020.

BACKGROUND OF THE INVENTION

Field of the Invention

This invention relates generally to accessories for printing on textiles and, more particularly, to a platen assembly operable to secure face masks in a selected one of a plurality of positions.

Description of the Prior Art

The use and design of printing devices to apply color and/or designs to fabrics and textiles is well established. For example, two of the more popular types of devices to accomplish the printing of colors and designs on textiles are direct to garment printers and screen printers. While each of these types of devices employs a different printing process to apply and set ink onto a given piece of fabric, one similarity is that they each require a piece of fabric (or "fabric item") to be fixed in place and rendered immobile during all or part of the printing process. It is understood that doing so allows for increased quality and consistency in printing.

In both direct to garment printing and screen printing, a platen is commonly employed when it is desired to fix a fabric item in place and render it immobile during the printing process. In many cases, a platen being employed may be sized and shaped so that it is suitable to be able to hold and immobilize at least the portion of the fabric item that is desired to be printed on. And with direct to garment printers, the platen may additionally be designed to interface with the printer so that the mechanical aspects of the printer can not merely apply ink but also move the platen, and the fabric item attached thereto, as needed or desired both before and during (and even potentially after) the printing process.

A limitation which still exists, however, is that many platens are suitable only to hold a single fabric item at a time. Another common limitation that exists is that many platens typically lack a plurality of fixed holding and tensioning mechanisms which allow a user to secure a fabric item without requiring assistance from others. As a result of these limitations, potential efficiencies related to both the number of separate items which can be printed on at the same time based on the capabilities of a printer, particularly a direct to garment printer, and the number of people required to position fabric items on platens so that they can be printed on, remain out of reach.

Thus, there remains a need for a platen assembly which can be used to print on smaller fabric items such as face masks and can hold a plurality of the same to be printed on at the same time. It would additionally be desirable for such a platen assembly for printing on fabric items such as face masks to include a plurality of edge interface portions which provide a plurality of distinct tensioning and holding mechanisms for aspects of the masks.

SUMMARY OF THE INVENTION

The present disclosure provides for a platen assembly for printing on small items, such as face masks, comprising: a base member defined by a substantially planar base body that has a pair of opposing base edges, a top surface, and a bottom surface, wherein the bottom surface is configured to be attached to a printer; a first set of interface portions integral with the each of the opposing base edges; at least one jig member configured to attach to the top surface of the base member, wherein at least one jig member includes opposing jig edges; a second set of interface portions integral with the each of the opposing jig edges; wherein when the at least one jig member is attached to the base member, the opposing base edges are not parallel to the opposing jig edges and the first set of interface portions and the second set of interface portions are on distinct vertical planes; and wherein when the at least one jig member is attached to the base member, the at least one jig member is configured to hold a fabric item with the first set of interface portions and the second set of interface portions engaging at least a portion of the fabric item.

It is an object of the present disclosure to provide a platen assembly which can be used to print on smaller fabric items such as face masks and can hold a plurality of the same to be printed on at the same time.

It is an additional object of the present disclosure to provide a platen assembly for printing on fabric items such as face masks which included a plurality of edge interface portions which provide a plurality of distinct tensioning and holding mechanisms for aspects of the masks.

DETAILED DESCRIPTION OF THE INVENTION

Described herein is a platen assembly for printing on face masks which includes a base member having a plurality of jig members mounted thereon. The base member has a top surface and a bottom surface, with its bottom surface operative to attach to a platen holding mechanism of a conventional direct to garment printer. Each of the jig members may be attached to the top surface of the base member and hold a single face mask in such a manner that it can be printed on. Edges of the base member and of each jig member include interface portions which allow portions of the face mask to be selectively threaded through to more effectively keep the face masks in place, being held smooth and taught.

Figure 1:
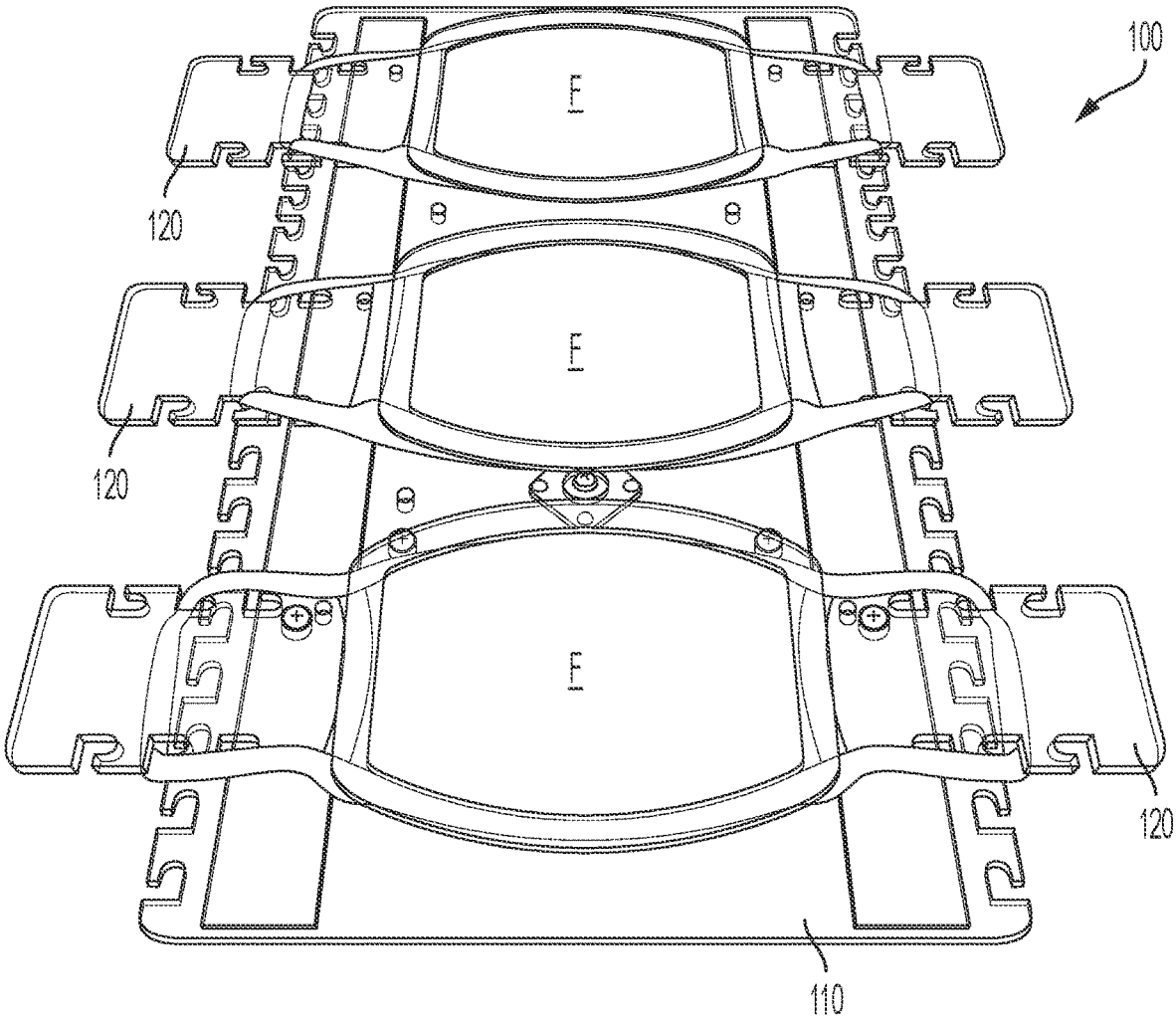
FIG. 1 is a top perspective view of a platen assembly for printing on face masks built in accordance with the present invention, shown mounted to a direct to garment printer and with three masks fixed thereto.
Figure 2:
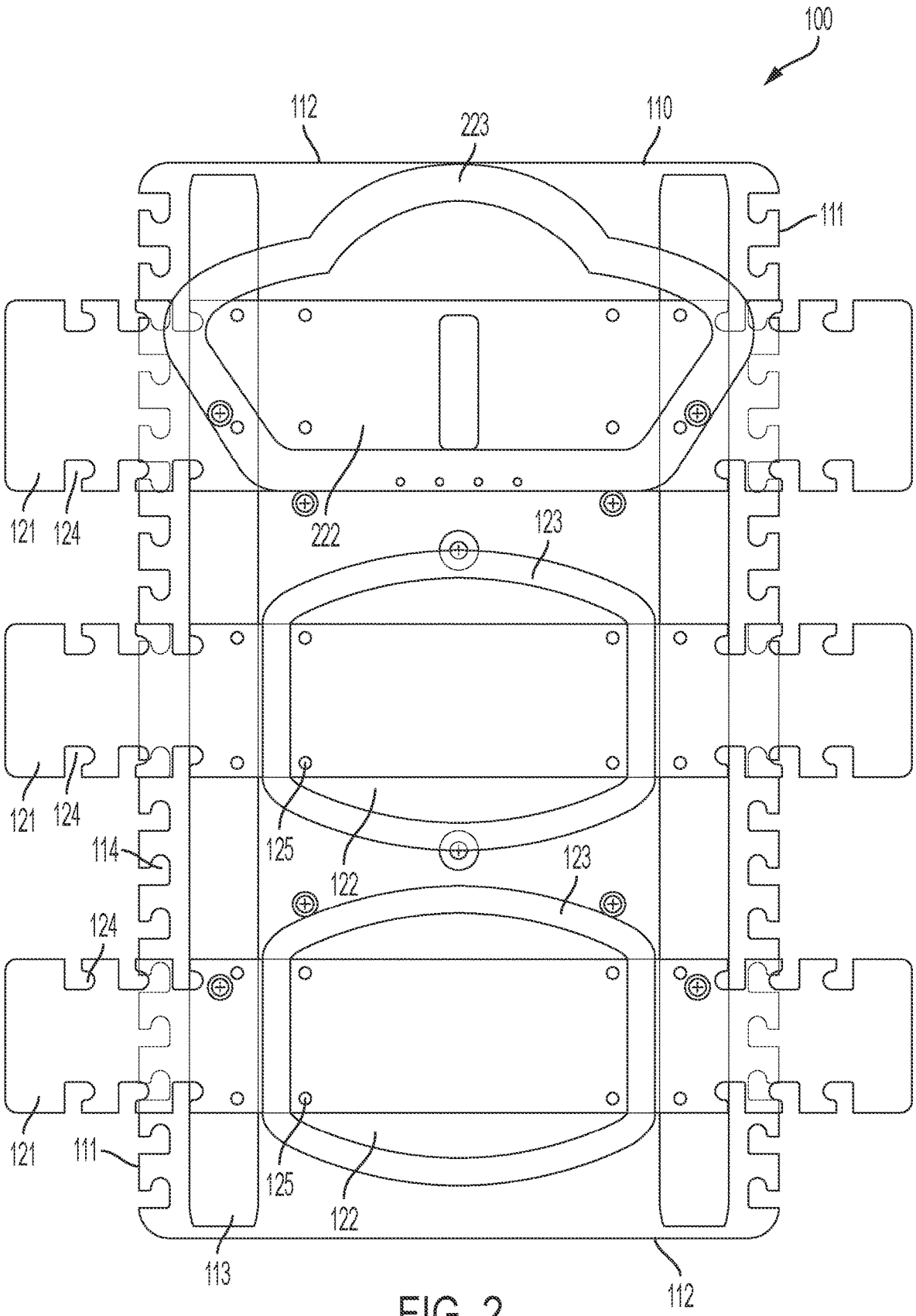
FIG. 2 is a top plan view of a platen assembly for printing on face masks built in accordance with the present invention.
Figure 3:
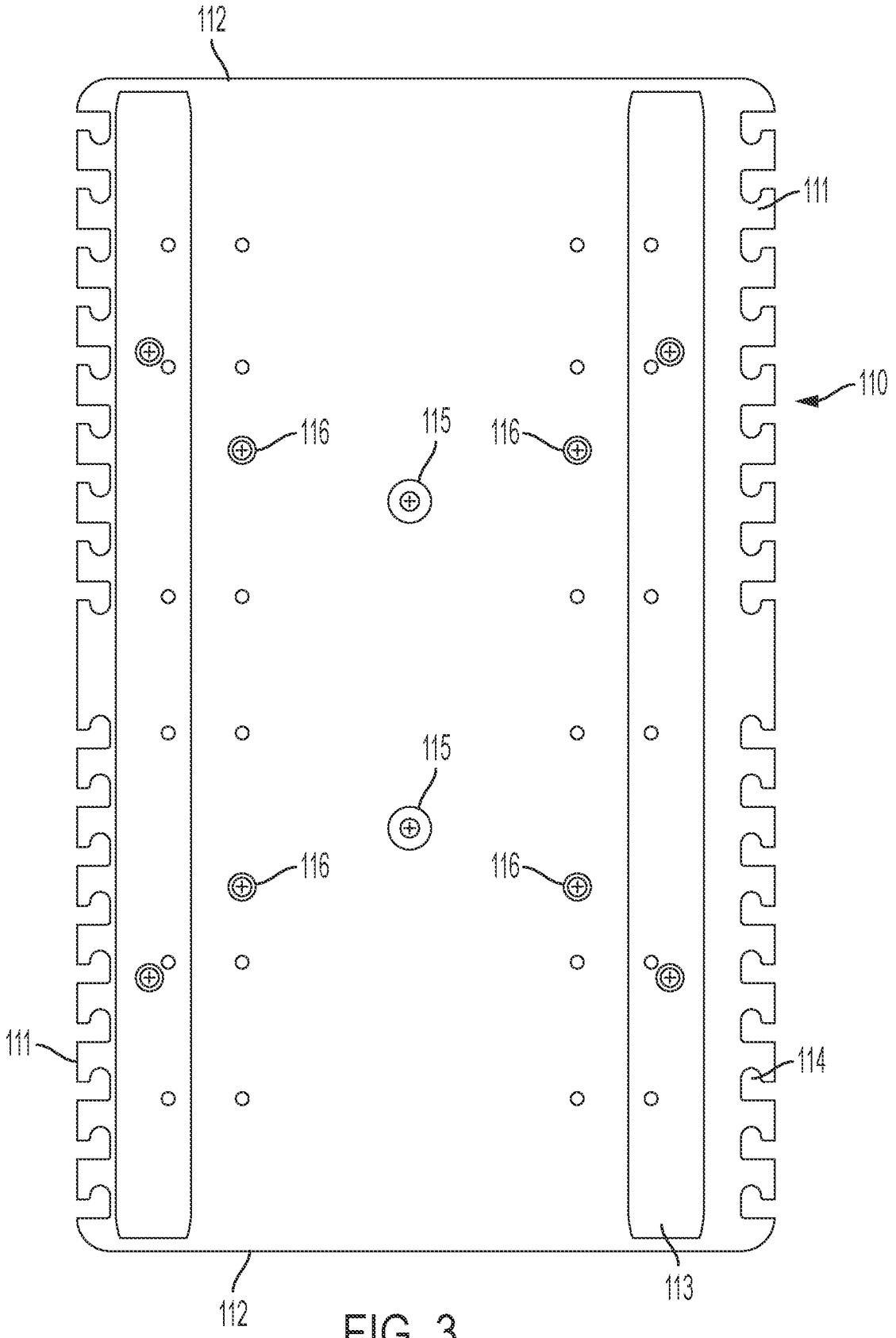
FIG. 3 is a top plan view of the base member of a platen assembly for printing on face masks built in accordance with the present invention.
Figure 4:
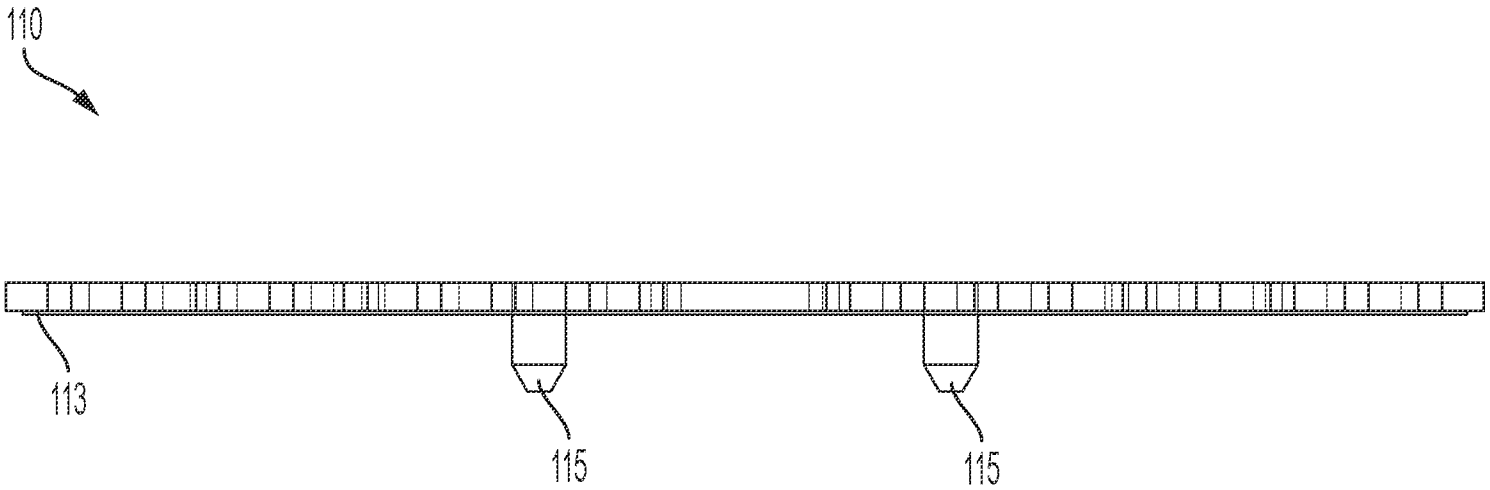
FIG. 4 is a side elevational view of the base member of a platen assembly for printing on face masks built in accordance with the present invention.
Figure 5:
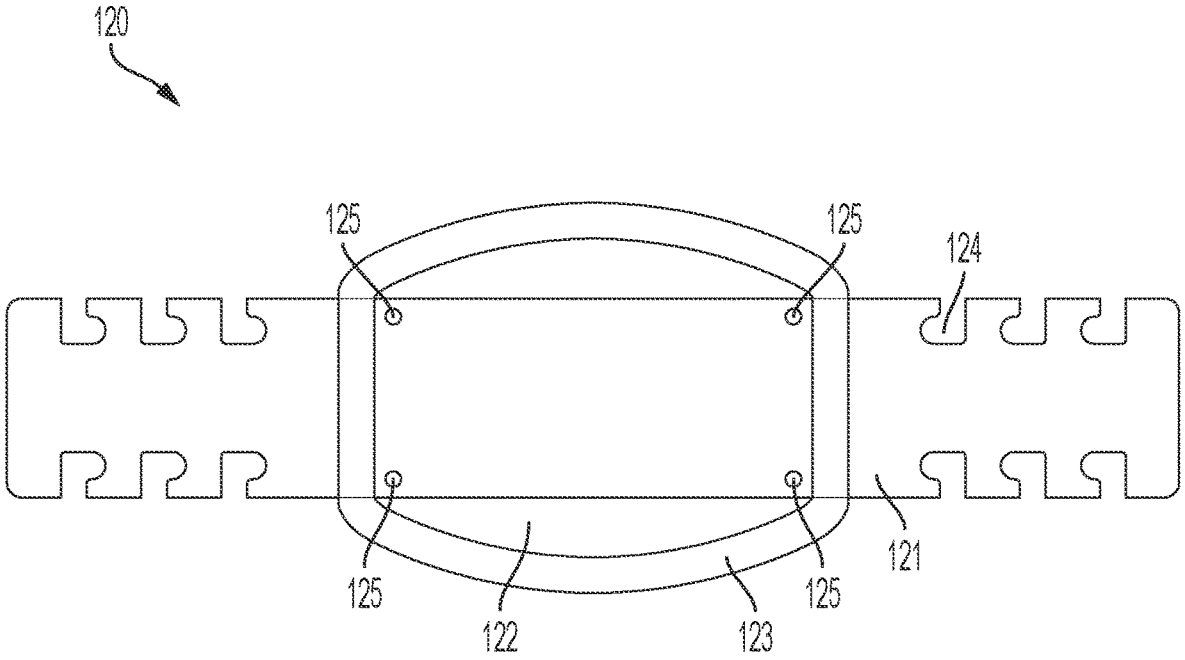
FIG. 5 is a top plan view of the jig member of a platen assembly for printing on face masks built in accordance with a first jig member embodiment the present invention.
Figure 6A:
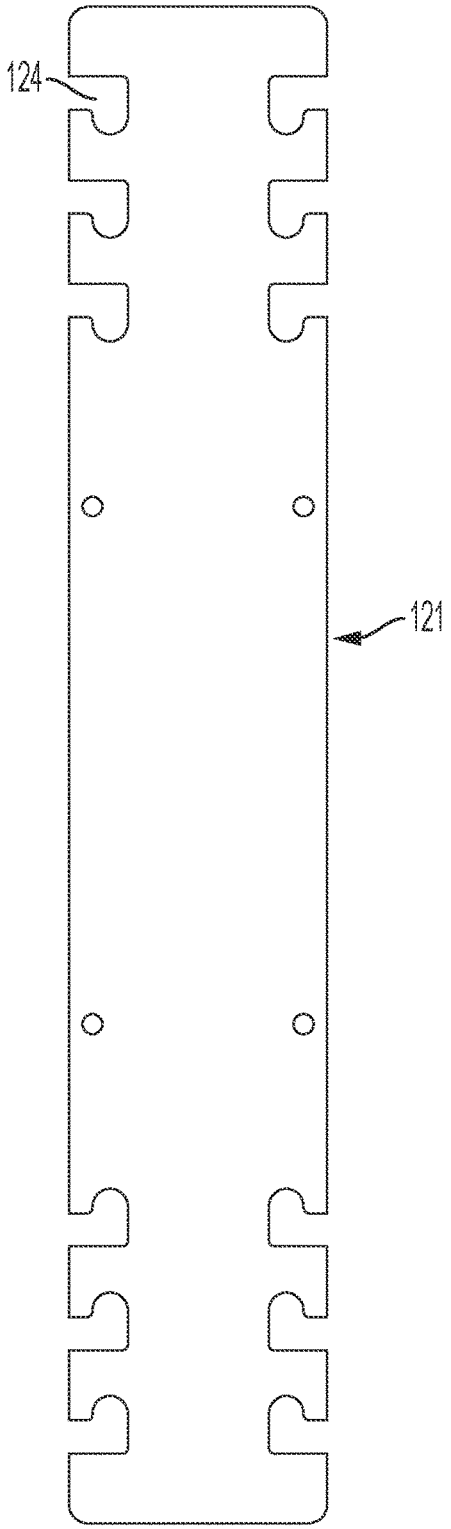
FIG. 6A is a top plan view of the jig base of the jig member of a platen assembly for printing on face masks built in accordance with a first jig member embodiment the present invention.
Figure 6B:
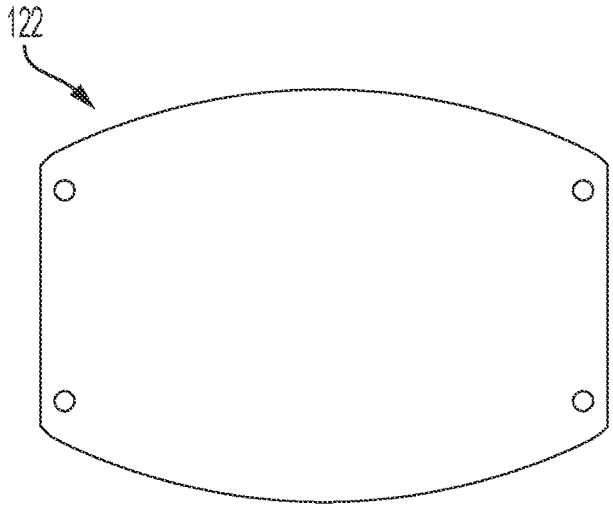
FIG. 6B is a top plan view of the jig riser of the jig member of a platen assembly for printing on face masks built in accordance with a first jig member embodiment the present invention.
Figure 6C:
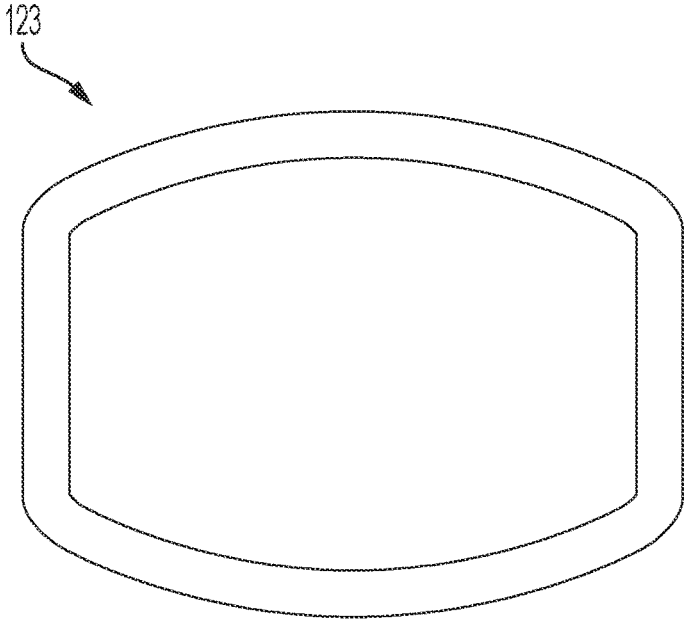
FIG. 6*c* is a top plan view of the outer ring of the jig member of a platen assembly for printing on face masks built in accordance with a first jig member embodiment the present invention.
Figure 7:
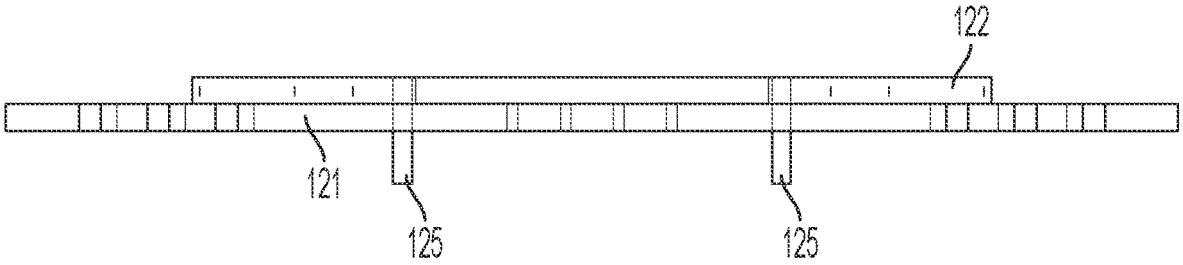
FIG. 7 is a side elevational view of the jig member of a platen assembly for printing on face masks built in accordance with a first jig member embodiment the present invention.

Referring now to the drawings and, in particular, FIGS. 1, 2, 3, 4, 5, 6*a*, 6*b*, 6*c*, and 7, a platen assembly 100 for printing on fabric items such as face masks F is formed from a rigid base member 110 with a plurality of rigid jig members 120. It is contemplated that the nature of the face masks referred to herein are ones with a covering aspect, which may be made of fabric, and a securing aspect such as straps. Examples include cloth face masks and surgical face masks.

The base member 110 may be defined by an elongated, substantially planar base body that has a pair of longitudinal base sides 111, a pair of transverse sides 112, a top surface, and a bottom surface. The base member 110 may further include a pair of elongated reinforcing braces 113 which are attached to the bottom surface and may run longitudinally along the base body. The reinforcing braces 113 may provide enhanced structural support and rigidity.

Present in each of the opposing longitudinal base sides 111 are a plurality of base interface portions 114, which may be defined as L-shaped cut outs. Embodiments of the base member 110 having L-shaped cut outs as the base interface portions 114 may having the L-shaped cut outs oriented so that the portion of the L-shaped cut out which is parallel with the longitudinal base sides extends in the direction away from the closest transverse side 112.

The base member 110 additionally includes several printer interface components which extend outwardly from its bottom surface. The printer interface components may include a pair of locator pins 115 and several attachment fasteners 116. In the illustrated embodiment, the printer interface components are positioned to allow the platen assembly 100 to be mounted onto a platen holding aspect of an Epson® SureColor F2100WE direct to garment printer. It is contemplated, however, that the printer interface components selectively positioned to allow the platen assembly 100 to be mounted onto the platen holding aspect of other types of direct to garment printers.

The jig members 120 may be formed from a jig base 121, a jig riser, 122, and an outer ring 123. The jig base 121 may be defined by an elongated, planar body that attaches to the top surface of the base member 110. The jig base 121 has a plurality of jig interface portions 124, which may be defined as L-shaped cut outs, integral with its longitudinal sides. The jig base 121 may additionally include a plurality of holes in its top surface (the surface opposite to where it attaches to the base member 110) which allow for the jig riser 122 to be coupled therewith, as discussed below.

The jig riser 122 forms the backstop structure for the portion of a fabric item that is to be printed on. In this regard, the shape of the jig riser 122 defines the shape of the portion of the fabric item that is to be printed on. Moreover, the jig riser 122 may be planar to provide a smooth, level surface for the fabric item to be printed on, as illustrated in the first jig member embodiment. Or, as discussed below, the jig riser 122 may include a channel or cut out that accommodates varying thickness in a fabric item being printed on.

The jig riser 122 may be coupled with the jig base 121 through the use of a plurality of dowels 125 which serve as mechanical couplers. As stated above, the jig base 121 includes a plurality of holes in its top surface. These holes in the jig base 121 may be each suitable to receive one of the dowels 125. Similarly, embodiments of the jig riser 122 may include a plurality of holes on its bottom surface and which also each can receive one of the dowels 125. When each of the plurality of dowels 125 are positioned with a first end in one of holes in the jig base 121, the jig riser 122 may be coupled with the jig base 121 by aligning the jig riser 122 so that each dowel 125 in the jig base 121 can also engage a hole in the jig riser 122 (specifically, the end of the each dowel 125 opposite the first end). In this regard, the dowels function as coupling mechanisms and locator pins.

The outer ring 123 is sized to be able to frictionally fit over a given jig riser 122, specifically once a fabric item has been stretched over the top surface of the jig riser 122. When in position in this manner, the outer ring 123 operates to hold the fabric item in place stretched, keeping the surface of the fabric item smooth and taught. It is appreciated that this helps provide an optimal surface to be printed on.

When assembled, the platen assembly 100 allows for multiple face masks F or other similarly sized fabric items to be securely positioned, placed on a platen holding aspect of a direct to garment printer, and printed on by the direct to garment printer. For an item such as a face mask F, or any item having straps/an extended portion which extends outwardly from a main portion (that is to be printed on), the platen assembly 100 provides a first set of interface portions in the form of the base interface portions 114 and a second set of interface portions in the form of the jig interface portions 124 so that the extended portions themselves can assist in getting and keeping the main portion in place, smooth and taught. Advantageously, the first set of interface portions and the second set of interface portions are on separate vertical plane and are orthogonal relative to one another, providing a user with many options on how to best make use of them, depending on factors like the length and elasticity of the extended portion.

Significantly, the platen assembly 100 disclosed herein, with its the dual interface portions, allows a single person to accomplish what in many instances requires two people to accomplish. To explain, in many instances, getting and keeping the a fabric item in place, smooth and taught, on a platen requires two people; one to hold it in place, smooth and taught, and the other to attach the mechanism used to hold the fabric item in place (like the outer ring 123 disclosed herein), smooth and taught (while the first person is still holding it). But because the platen assembly 100 disclosed herein allows a user to get and keep the main portion of a fabric item in place, smooth and taught, by engaging the dual interface portions with the extended portions, the same user can do this and then slide the outer ring 123 on without worrying about the main portion moving or loosening. Thus, this action both supplements and enhances the operation of the outer ring 123.

Figure 8:
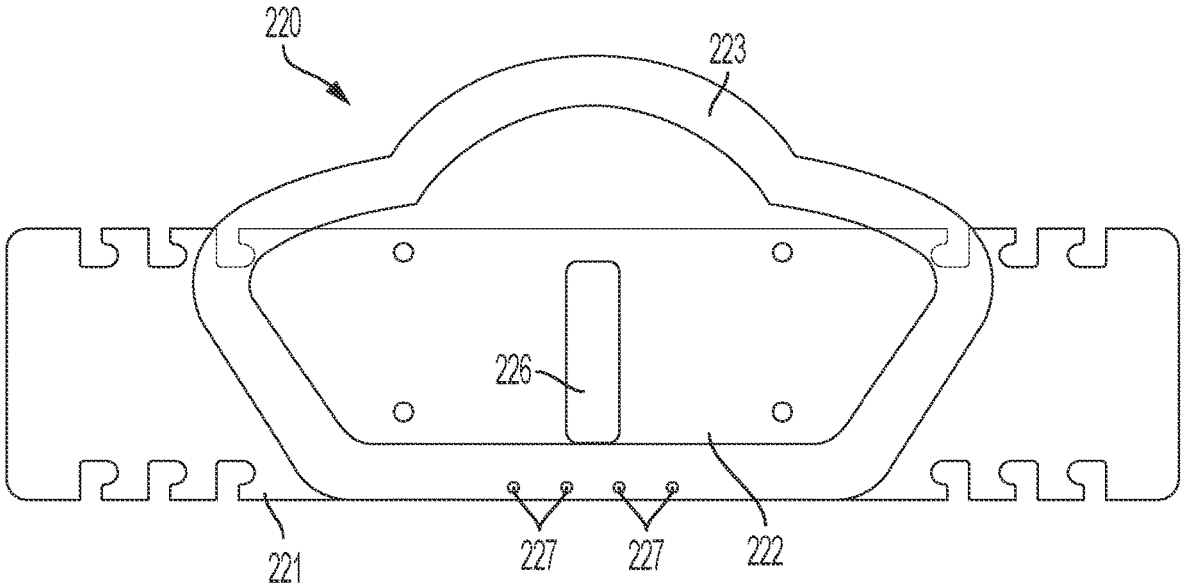
FIG. 8 is a top plan view of the jig member of a platen assembly for printing on face masks built in accordance with a second jig member embodiment the present invention.
Figure 9A:
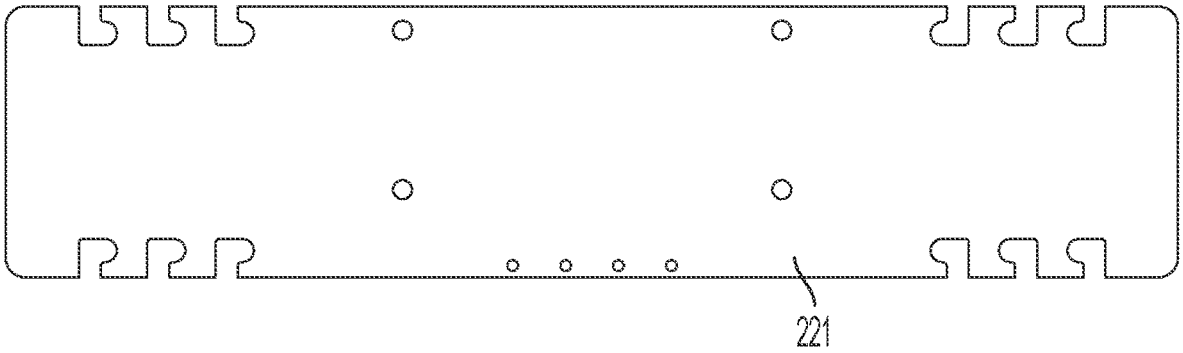
FIG. 9A is a top plan view of the jig base of the jig member of a platen assembly for printing on face masks built in accordance with a second jig member embodiment the present invention.
Figure 9B:
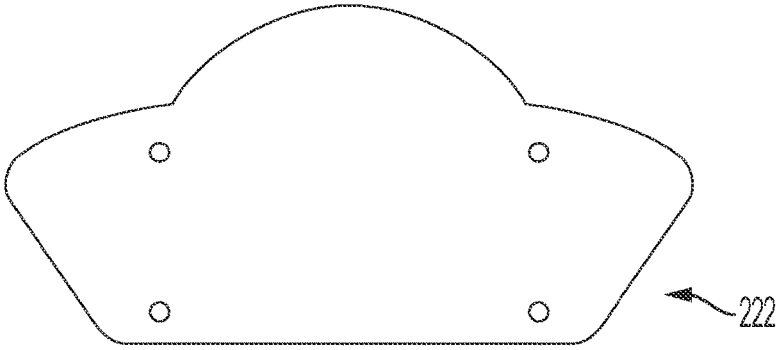
FIG. 9B is a top plan view of the jig riser of the jig member of a platen assembly for printing on face masks built in accordance with a second jig member embodiment the present invention.
Figure 9C:
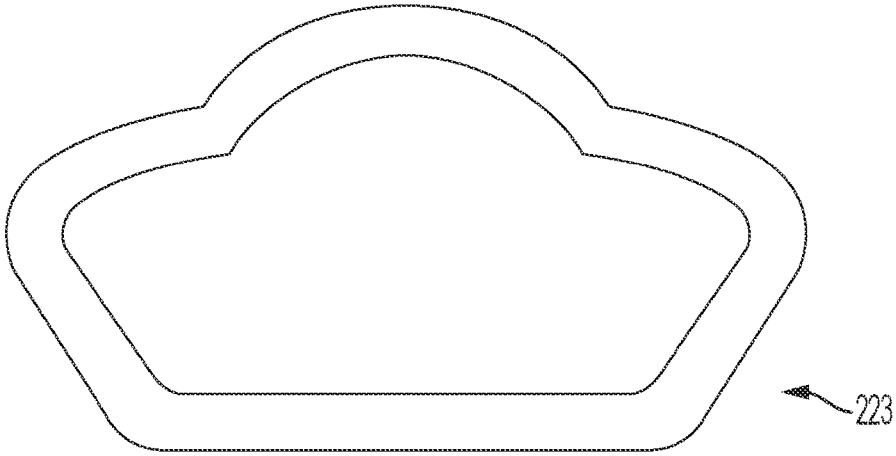
FIG. 9C is a top plan view of the outer ring of the jig member of a platen assembly for printing on face masks built in accordance with a second jig member embodiment the present invention

Referring now to FIGS. 2, 8, 9*a*, 9*b*, and 9*c*, alternate jig member designs 220 may be utilized depending on the shape of the face mask or other fabric item to be printed on. The second jig member embodiment includes the same three components as the first, namely a jig base 221, a jig riser, 222, and an outer ring 223. The components also work in substantially the same way together and serve the same function. In the second jig member embodiment, however, the jig riser 222 and the outer ring 223 have a different shape. Also, the second jig member embodiment illustrates two additional features which may be included in any embodiment of a jig member.

As shown in the second jig member embodiment, the jig riser 222 includes a depression 226 in its top surface that allows for a face mask or other fabric item to lay flat even if it includes a middle seam that is thicker than the rest of the material. It is appreciated that the depression would allow the thicker middle seam (or other thicker portion) to sink down below the rest of the surface of the jig riser 222.

Also shown in the second jig member embodiment is a pair of matching holes 227 on both the jig riser 222 and the outer ring 223. It is contemplated that these holes allow for the attachment of a hinge to the jig riser 222 and the outer ring 223, allowing the outer ring 223 to open and close in clamshell fashion.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A platen assembly for printing on small fabric items, comprising:

a base member defined by a substantially planar base body that has a pair of opposing base edges, a top surface, and a bottom surface, wherein the bottom surface is configured to be attached to a printer;

at least one jig member configured to attach to the top surface of the base member, wherein the at least one jig member includes opposing jig edges;

wherein the at least one jig member includes a jig base with which the opposing jig edges are integral and which includes a surface which contacts the base member when the at least one jig member is attached to the base member;

wherein the at least one jig member includes a jig riser that is removably coupled with the jig base and an outer ring that is sized to slidably engage the jig riser, with the at least one jig member configured to hold a fabric item through the engagement of the jig riser and the outer ring with both the jig riser and the outer ring contacting at least a first portion of the fabric item and at least one of a first set of interface portions integral with the each of the opposing base edges and a second set of interface portions integral with the each of the opposing jig edges, wherein when the at least one jig member is attached to the base member, the at least one jig member is additionally configured to hold the fabric item with the at least one of the first set of interface portions and the second set of interface portions engaging at least a second portion of the fabric item which is distinct from the first portion of the fabric item.

2. The platen assembly for printing on small fabric items of claim 1, wherein when the at least one jig member is attached to the base member, the opposing base edges and opposing jig edges are respectively oriented so that a first line segment parallel to at least one of the opposing base edges is perpendicular to a second line segment parallel to at least one of the opposing jig edges.

3. The platen assembly for printing on small fabric items of claim 1, wherein the jig riser is removably attached to the jig base through a plurality of dowels which engage both the jig riser and the jig base.

4. The platen assembly for printing on small fabric items of claim 1, wherein the base member includes at least one elongated reinforcing brace running longitudinally along the bottom surface.

5. The platen assembly for printing on small fabric items of claim 1, wherein the first set of interface portions is defined by a plurality of L-shaped base cut out portions in the opposing base edges and the second set of interface portions is defined by a plurality of L-shaped jig cut out portions in the opposing jig edges.

6. The platen assembly for printing on small fabric items of claim 1, wherein when the at least one jig member is attached to the base member, the opposing base edges are not parallel to the opposing jig edges and are on distinct vertical planes.

7. A platen assembly for printing on small fabric items, comprising:

a base member defined by a substantially planar elongated base body that has a pair of opposing elongated base edges, a top surface, and a bottom surface, wherein the bottom surface is configured to be attached to a printer;

at least one jig member attached to the top surface of the base member, wherein the at least one jig member is elongated and includes opposing elongated jig edges;

wherein the at least one jig member includes a jig base with which the opposing elongated jig edges are integral and which includes a surface which contacts the base member when the at least one jig member is attached to the base member;

wherein the at least one jig member includes a jig riser that is removably coupled with the jig base and an outer ring that is sized to slidably engage the jig riser, with the at least one jig member configured to hold a fabric item through the engagement of the jig riser and the outer ring with both the jig riser and the outer ring contacting at least a first portion of the fabric item; and wherein the opposing elongated base edges are not parallel to the opposing elongated jig edges and are on distinct vertical planes.

8. The platen assembly for printing on small fabric items of claim 7, additionally comprising a first set of interface portions integral with each of the opposing elongated base edges and a second set of interface portions integral with the each of the opposing elongated jig edges, wherein when the at least one jig member is attached to the base member, the at least one jig member is additionally configured to hold the fabric item with at least one of the first set of interface portions and the second set of interface portions engaging at least a second portion of the fabric item which is distinct from the first portion of the fabric item.

9. The platen assembly for printing on small fabric items of claim 8, wherein the first set of interface portions is defined by a plurality of base cut out portions in the opposing elongated base edges and the second set of interface portions is defined by a plurality of jig cut out portions in the opposing elongated jig edges.

10. The platen assembly for printing on small fabric items of claim 8, wherein the first set of interface portions is defined by a plurality of L-shaped base cut out portions in the opposing elongated base edges and the second set of interface portions is defined by a plurality of L-shaped jig cut out portions in the opposing elongated jig edges.

11. The platen assembly for printing on small fabric items of claim 7, wherein the opposing elongated base edges and opposing elongated jig edges are respectively oriented so that a first line segment parallel to at least one of the opposing elongated base edges is perpendicular to a second line segment parallel to at least one of the opposing elongated jig edges.

12. The platen assembly for printing on small fabric items of claim 7, wherein the jig riser is removably attached to the jig base through a plurality of dowels which engage both the jig riser and the jig base.

13. The platen assembly for printing on small fabric items of claim 7, wherein the base member includes at least one elongated reinforcing brace running longitudinally along the bottom surface.

14. The platen assembly for printing on small fabric items of claim 7, additionally comprising at least one of a first set of interface portions integral with the each of the opposing elongated base edges and a second set of interface portions integral with the each of the opposing elongated jig edges, wherein when the at least one jig member is attached to the base member, the at least one jig member is additionally configured to hold the fabric item with one or more of the at least one of the first set of interface portions and the second set of interface portions engaging at least a second portion of the fabric item which is distinct from the first portion of the fabric item.

* * * * *